US007509947B2

(12) United States Patent
Tansug et al.

(10) Patent No.: US 7,509,947 B2
(45) Date of Patent: Mar. 31, 2009

(54) FUEL INJECTION PUMP

(75) Inventors: Onur Mehmet Tansug, Izmir (TR); George N Felton, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/724,456

(22) Filed: Mar. 15, 2007

(65) Prior Publication Data

US 2007/0217927 A1 Sep. 20, 2007

(51) Int. Cl.
*F02M 37/04* (2006.01)

(52) U.S. Cl. ..... 123/500; 123/501; 123/446

(58) Field of Classification Search ..... 123/446–447, 123/500–502, 90.46, 90.48, 90.52, 90.56–90.59
See application file for complete search history.

(56) References Cited

U.S. PATENT DOCUMENTS 2,863,438 A 12/1958 Challis
3,728,990 A * 4/1973 Lampredi et al. ..... 123/90.56
3,875,911 A * 4/1975 Joseph ..... 123/90.55
4,112,884 A * 9/1978 Tominaga ..... 123/90.48
4,228,771 A * 10/1980 Krieg ..... 123/90.55
4,235,374 A * 11/1980 Walter et al. ..... 239/90
4,249,499 A * 2/1981 Perr ..... 123/502
4,254,749 A * 3/1981 Krieg et al. ..... 123/502
4,281,792 A * 8/1981 Sisson et al. ..... 239/5
4,291,652 A * 9/1981 Trzoska ..... 123/90.57
4,395,979 A * 8/1983 Perr ..... 123/90.16
4,402,456 A * 9/1983 Schneider ..... 239/90
4,407,241 A * 10/1983 Butler et al. ..... 123/90.16
4,503,825 A * 3/1985 Schneider ..... 123/446
4,524,731 A * 6/1985 Rhoads ..... 123/90.57
4,621,605 A * 11/1986 Carey et al. ..... 123/446
4,699,320 A * 10/1987 Sisson et al. ..... 239/90
5,033,442 A 7/1991 Perr et al.
5,193,510 A 3/1993 Straubel
5,233,951 A * 8/1993 Hausknecht ..... 123/90.12
5,245,958 A * 9/1993 Krieg et al. ..... 123/90.55
5,364,028 A * 11/1994 Wozniak ..... 239/70

(Continued)

FOREIGN PATENT DOCUMENTS

EP 1076173 2/2001

(Continued)

*Primary Examiner*—Thomas N Moulis
(74) *Attorney, Agent, or Firm*—David P. Wood

(57) ABSTRACT

A fuel pump for use in an internal combustion engine comprises a pump housing provided with a plunger bore, a pumping plunger which is movable within the plunger bore by means of a cam drive arrangement to perform a pumping stroke to pressurise fuel within a pumping chamber and a cam follower arrangement interposed between the cam drive arrangement and the pumping plunger so as to transmit a drive force of the drive arrangement to the pumping plunger. The cam follower arrangement includes a timing advance piston for advancing or retarding the timing of the pumping stroke, and control means for controlling the timing advance piston so as to advance or retard the timing of the pumping stroke. The timing advance piston is provided with a groove on its outer surface for receiving fluid, thereby to provide a centralising force to the timing advance piston, in use. The cam follower arrangement advantageously includes an advance piston spring which is housed within a spring cage received within a lower portion of a return spring for the pumping plunger.

24 Claims, 4 Drawing Sheets

U.S. PATENT DOCUMENTS

| | | | | |
|---|---|---|---|---|
| 5,372,114 | A * | 12/1994 | Gant et al. | 123/502 |
| 6,039,018 | A * | 3/2000 | Spath | 123/90.55 |
| 6,619,186 | B2 * | 9/2003 | Duquette et al. | 92/60.5 |
| 6,748,930 | B2 * | 6/2004 | Bofinger et al. | 123/502 |
| 6,786,186 | B2 * | 9/2004 | de Ojeda | 123/90.55 |
| 2002/0096136 | A1 * | 7/2002 | Spath et al. | 123/90.53 |
| 2002/0162524 | A1 * | 11/2002 | Ojeda | 123/90.55 |
| 2005/0178351 | A1 * | 8/2005 | Mayer et al. | 123/90.48 |
| 2007/0215087 | A1 * | 9/2007 | Best et al. | 123/90.48 |

FOREIGN PATENT DOCUMENTS

| | | |
|---|---|---|
| GB | 2039601 | 8/1980 |

* cited by examiner

FUEL INJECTION PUMP

TECHNICAL FIELD

The invention relates to a fuel injection pump for an internal combustion engine (for example, a diesel engine). In particular, the invention relates to a fuel injection pump provided with timing advance for controlling the timing of pressurisation of fuel.

BACKGROUND TO THE INVENTION

In known fuel injection systems, a high pressure fuel injection pump is arranged to supply fuel from a pumping chamber to an associated injector arranged downstream of the pumping chamber. The injector may be arranged in a common housing with the pump or may be separated from the pump by a dedicated injector supply line. The pump includes a pumping plunger which is reciprocal within a plunger bore to perform a pumping cycle including a pumping stroke and a return stroke. During the pumping stroke, the pumping plunger is driven by means of a cam drive arrangement to reduce the volume of the pumping chamber so that fuel within the pumping chamber is pressurised. Pressurised fuel is delivered from the pumping chamber to the injector through a pump outlet via an outlet valve. During the return stroke (or filling stroke), the pumping plunger is withdrawn from the plunger bore under a return spring force so as to increase the volume of the pumping chamber. Fuel fills the pumping chamber through a fill/spill port in communication with a low pressure reservoir during that part of the return stroke for which the fill/spill port is open.

It is particularly important to be able to control accurately the timing and quantity of fuel delivery to the engine cylinder so as to improve fuel economy and engine emissions. For this purpose it is known to provide the pumping plunger with control features so as to provide control of the quantity and timing of fuel that is delivered during the pumping cycle. By way of example, the plunger defines an upper control edge on its end face in the pumping chamber and is provided with a helical groove on its side face to define a lower control edge. During the pumping stroke, pressurisation of fuel in the pumping chamber is commenced when the upper control edge closes the fill/spill port into the pumping chamber. Pressurisation is terminated when the pumping plunger has moved sufficiently far through the pumping stroke for the lower control edge defined by the helical groove to open communication between the pumping chamber and the fill/spill port and, hence, the low pressure drain.

The angular position of the pumping plunger determines the point in the pumping stroke at which the upper control edge of the pumping plunger closes the fill/spill port, thus starting fuel pressurisation earlier, or later, in the pumping stroke. Consequently, this varies the point in the injection cycle at which injection is initiated. The angular position of the pumping plunger also determines the point in the pumping cycle at which the helical groove registers with the fill/spill port, thus terminating pressurisation (and hence injection) earlier, or later, in the pumping stroke. The variation of the effective stroke between the upper control edge of the pumping plunger and the lower control edge of the helical groove varies the delivered fuel quantity. During the effective stroke, the registration of the outer surface of the pumping plunger with the fill/spill port closes communication between the fill/spill port and the low pressure drain.

To provide further adjustment of the timing of initiation of fuel delivery, it is known to provide the pump with a timing advance arrangement. A cam follower arrangement is typically disposed between the pumping plunger and the cam drive arrangement, the cam follower arrangement including a timing advance piston which is movable in response to fluid pressure controlled by an advance control. The advance piston is mounted within a bore provided in a cam follower component, such as a tappet. By pressurising the advance piston, it is displaced outwardly from the rotational axis of the cam which, in turn, displaces the pumping plunger further away from the rotational axis of the cam. The position of the pumping plunger within the plunger bore determines fuel injection timing, as described above, and so the advance piston provides a means for adjusting the timing, depending on whether the advance piston is advanced or retracted under the advance control. The use of a timing advance device of the aforementioned type is known to have particular benefits when running under cold conditions as it allows white smoke emissions to be decreased.

It has been observed that in fuel pumps provided with a timing advance device as described above, there is a tendency for the advance piston and the tappet bore to become misaligned during running due to the poor length to diameter ratio of the piston. Also, any concentricity misalignment of the advance piston relative to the tappet bore will affect the leakage rate through the clearance between the components, giving an undesirable performance variability between different units.

It is an object of the present invention to provide a timing advance device for use in a fuel pump which overcomes or alleviates the aforementioned problems.

SUMMARY OF THE INVENTION

According to a first aspect of the invention, there is provided a fuel pump for use in an internal combustion engine, the fuel pump comprising a pump housing provided with a plunger bore, a pumping plunger which is movable within the plunger bore by means of a drive arrangement to perform a pumping stroke to pressurise fuel within a pumping chamber, and a cam follower arrangement interposed between the cam drive arrangement and the pumping plunger so as to transmit a drive force of the drive arrangement to the pumping plunger. The cam follower arrangement includes a timing advance piston and control means for controlling the timing advance piston so as to advance or retard the timing of the pumping stroke. The timing advance piston is provided with a groove on its outer surface for receiving fluid, thereby to provide a centralising force to the timing advance piston, in use.

In a preferred embodiment, the cam follower arrangement includes a follower body (e.g. a tappet drive member) provided with a bore within which the timing advance piston is moved.

It is convenient for the bore in the tappet to be made relatively short, but this then provides only a short guidance length for the timing advance piston. As a result, it has been observed in conventional fuel pumps that there is a tendency for the timing advance piston to tilt off-axis in the tappet bore as it is moved back and forth to adjust the timing of the pumping stroke. In extreme circumstances the timing advance piston may become stuck altogether. The present invention avoids this problem as the outer groove receives fluid which applies a radial centralising or balancing force to the outer surface of the timing advance piston, thus reducing the tendency of the piston to tilt. The balancing force is achieved by means of supplying fluid, preferably through a lateral drilling extending through the timing advance piston, to an annular groove on the outer surface of the piston.

In a preferred embodiment, the groove is an annular groove which extends fully around the circumference of the outer surface of the timing advance piston. This provides a particularly beneficial balancing force to the timing advance piston. Other options for the groove, however, are also envisaged.

Preferably, the timing advance piston defines a control chamber for receiving fluid under the control of the control means. The control means typically includes a valve for controlling fluid supply to the control chamber. The valve is preferably a temperature-sensitive valve which is operable to permit fluid supply to the control chamber under relatively cold conditions. In this way the timing of the fuel pump can be adjusted in response to engine temperature and, in particular, timing can be advanced under cold conditions.

The control means may further include a non-return valve arranged at an inlet to the control chamber. Preferably, the non-return valve is retained within a further spring cage located within the control chamber.

It is an advantage to further provide a retaining spring to act on the further spring cage, so as to retain the cage in position during the return stroke of the pumping plunger and a period of the pumping stroke of the pumping plunger for which the pumping plunger is decelerating. Without the retaining spring there is a risk that the further spring cage could become dislodged.

In a preferred embodiment, the control chamber communicates with the groove by means of a lateral drilling or bore provided in the timing advance piston.

It is advantageous to provide the pump with a plunger return spring which serves to bias the pumping plunger outwardly from the plunger bore to perform a return stroke.

It is further advantageous to provide the cam follower arrangement with an advance piston spring which serves to urge the timing advance piston into a retarded position. The advance piston spring and the plunger return spring are preferably substantially concentric with one another.

A spring cage may be provided, preferably through which an end of the pumping plunger is received, wherein the advance piston spring is housed within the spring cage.

In a preferred configuration, one end of the advance piston spring is in engagement with an internal surface of the spring cage and the other end of the advance piston spring is in engagement with a spring plate carried by the pumping plunger.

It is also preferable for the spring cage to be carried by a drive member of the cam follower arrangement.

According to a second aspect of the invention, there is provided a fuel pump for use in an internal combustion engine, the fuel pump comprising a pump housing provided with a plunger bore, a pumping plunger which is movable within the plunger bore by means of a drive arrangement to perform a pumping stroke to pressurise fuel within a pumping chamber and a cam follower arrangement interposed between the cam drive arrangement and the pumping plunger so as to transmit a drive force of the cam drive arrangement to the pumping plunger. The cam follower arrangement includes a timing advance piston for advancing or retarding the timing of the pumping stroke. The timing advance piston is biased into a retarded position by means of an advance piston spring. The cam follower arrangement is provided with a spring cage for housing the advance piston spring.

The provision of the spring cage to house the advance piston spring is particularly advantageous because it removes any dependency of the pre-load of the advance piston spring on the timing shim that is usually provided on the main pump housing to set the static pump timing.

It will be appreciated that the preferred and/or optional features of the first aspect of the invention may also be incorporated in the second aspect of the invention, alone or in appropriate combination.

BRIEF DESCRIPTION OF THE DRAWINGS

The invention will now be described, by way of example only, with reference to the accompanying drawings in which.

DETAILED DESCRIPTION OF PREFERRED EMBODIMENTS OF THE INVENTION

Figure 1:
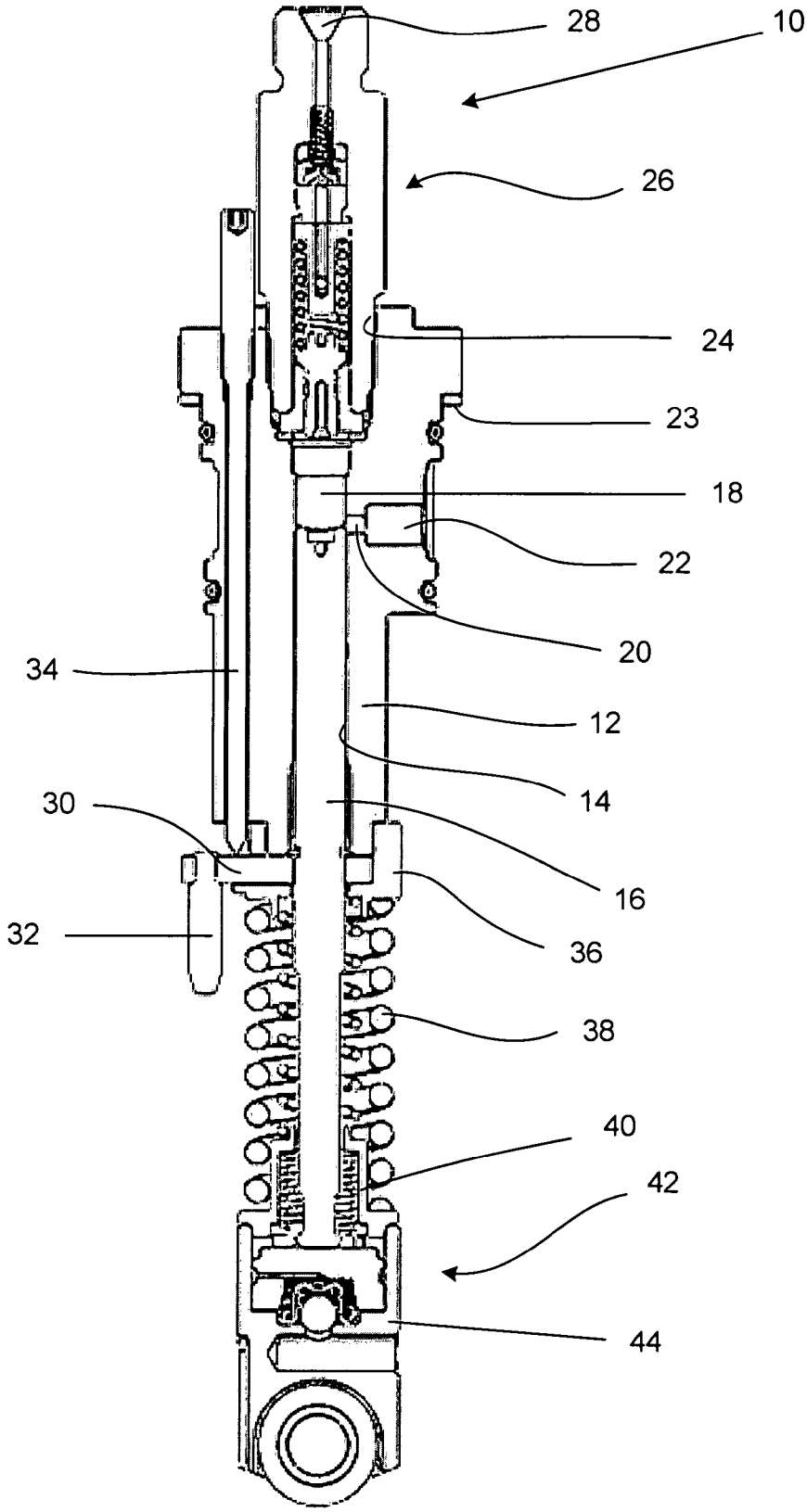
FIG. 1 is a section view of a fuel pump of a first embodiment of the invention incorporating a timing advance arrangement.

It should be noted that the terms 'upper' and 'lower' are used with reference to the orientation of the fuel injection pump as shown in the drawings and, as such, are not intended to limit the fuel injection pump to a particular orientation.

Figure 2:
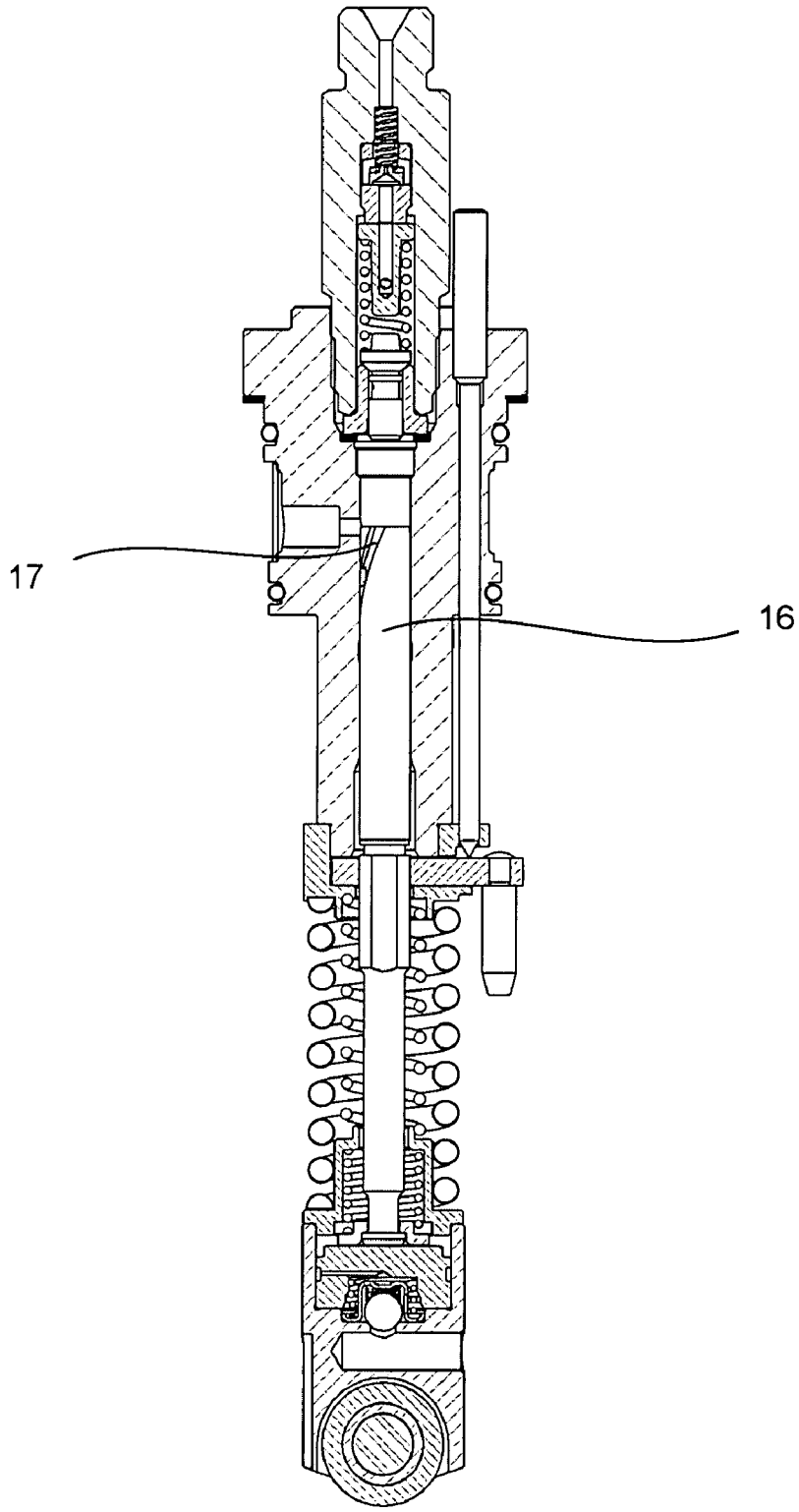
FIG. 2 is an alternative section view of the fuel pump in FIG. 1, to illustrate a timing control feature on the plunger.

Referring to FIG. 1, a fuel pump, referred to generally as 10, for use in delivering fuel to an associated, dedicated injector (not shown) includes a main pump housing 12 provided with a bore 14 within which a pumping plunger 16 is moved, back and forth, under the influence of an engine driven cam drive arrangement (not shown). The plunger bore 14 defines, together with an upper end surface of the pumping plunger 16, a pumping chamber 18 within which fuel is pressurised to a relatively high level as the pumping plunger 16 is driven, in use. A fill/spill port 20 is provided in the wall of the plunger bore 14 at the end of a drilling 22 which communicates with a source of fuel at a relatively low pressure, for example a low pressure displacement pump (not shown). As can be seen in FIG. 2, the pumping plunger 16 is provided with a helical groove 17 (not visible in FIG. 1) on its surface which defines a lower control edge of the pumping plunger 16. The end face of the pumping plunger 16 in the pumping chamber 18 defines an upper control edge. A portion of the helical groove 17 on the side of the pumping plunger 16 is registerable with the fill/spill port 20. Fuel is delivered to (filled), and expelled from (spilled), the pumping chamber 18 throughout the pumping cycle of the pump, depending on the axial and angular position of the pumping plunger 16 within the bore 14 and, hence, the position of the helical groove 17 relative to the fill/spill port 20. An annular shim 23 (referred to as the timing shim) is provided on the pump housing 12, the thickness of which is selected so as to compensate for manufacturing variability in pump static timing.

The upper end of the main pump housing 12 is provided with a recess 24 within which a spring-biased outlet valve arrangement 26 is received, in a screw threaded manner, to control the flow of fuel between the pumping chamber 18 and a pump outlet 28. The pump outlet 28 connects with a fuel supply pipe (not shown) to the injector. In use, fuel at relatively high pressure, which has been pressurised within the pumping chamber 18, is delivered through the pump outlet 28 to the injector via the outlet valve arrangement 26, when open. The outlet valve arrangement 26 is caused to open, against a spring force, when fuel pressure within the pumping chamber 18 exceeds a predetermined amount. Injection of fuel into the engine is initiated in response to fuel being delivered to the injector, which initiates opening of the injector. The outlet valve arrangement 26 provides a non-return valve function so that fuel that is delivered to the injector is not able to flow back into the pumping chamber 18.

In order to vary the delivery volume of the fuel pump 10, the pumping plunger 16 is provided with a control arm 30 which extends radially away from an approximate mid-point of the pumping plunger 16. A control pin 32 extends downwardly from the control arm 30 and engages with a fuel delivery rack (not shown) when the fuel pump 10 is mounted within the associated engine. The position of the fuel delivery rack is determined indirectly by the engine governor. A locking pin 34 extends through the upper region of the housing 12 and is received through a part of a spring abutment plate 36 carried at the lower end of the pump housing 12 so that a lower tip of the pin 34 engages with the control arm 30.

Movement of the rack causes angular movement of the pumping plunger 16 within the plunger bore 14 about its longitudinal axis. The angular position of the pumping plunger 16 determines the point during the pumping stroke at which the upper control edge of the pumping plunger 16 closes the fill/spill port 20 to commence pressurisation and, hence, injection. The angular position of the pumping plunger 16 also determines the point during the pumping stoke when the helical groove 17 registers with the fill/spill port 20 to terminate fuel pressurisation and, hence, injection. The locking pin 34 serves to lock the control arm 30, and hence the pumping plunger 16, in position so as to set the pump in a position in which good cylinder-to-cylinder balance is achieved for all pumps of the engine. After installation of the pump in the engine, the locking pin 34 is removed and the rack moves freely under the influence of the engine governor.

Figure 3:
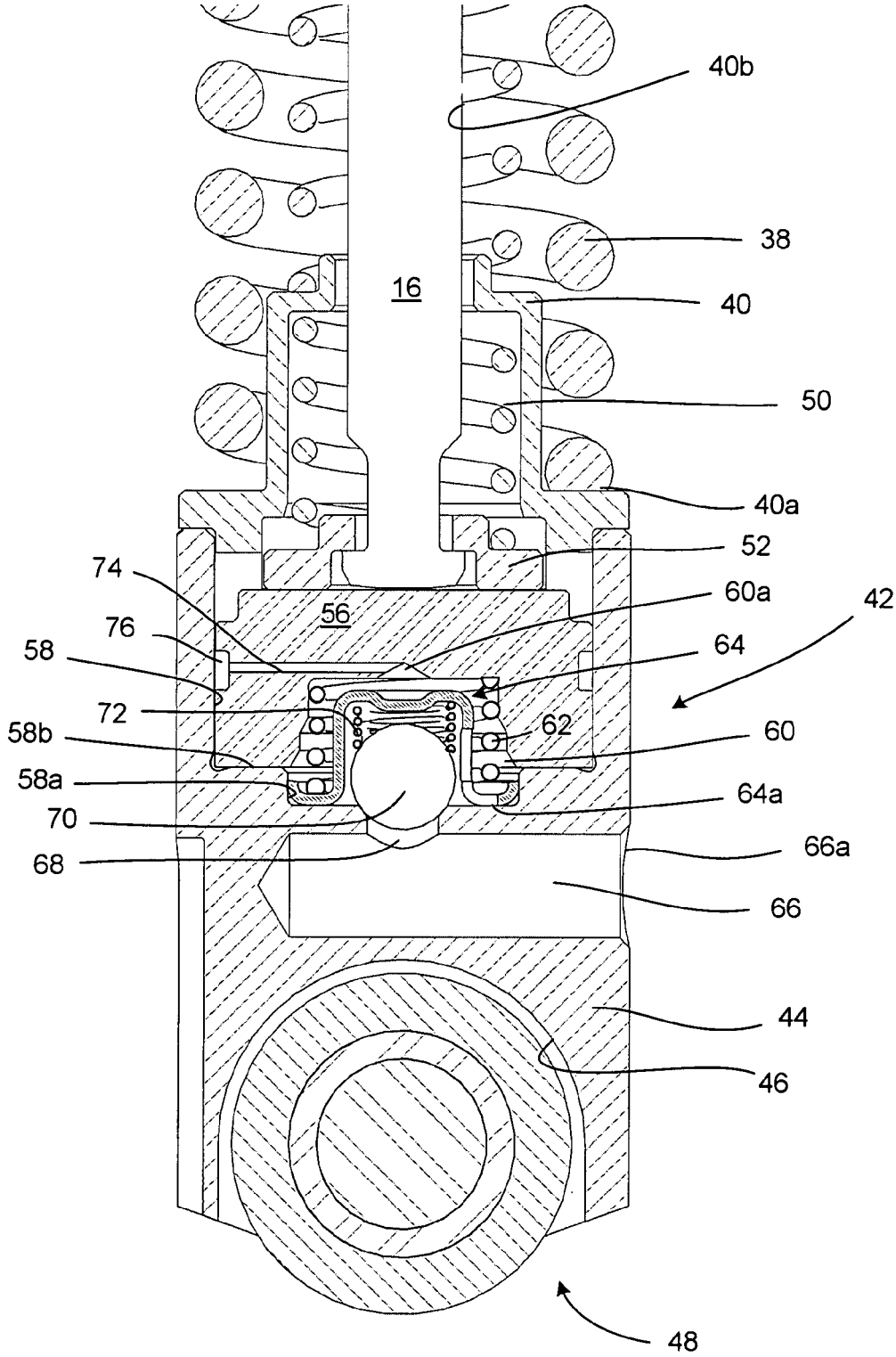
FIG. 3 is an enlarged view of a part of the timing advance arrangement in FIGS. 1 and 2.

As shown in more detail in FIG. 3, the pumping plunger 16 is received through a plunger return spring 38, in the form of a helical spring, one end of which abuts the lower end of the spring abutment plate 36 and the other end of which abuts a first spring cage or housing 40, referred to as the advance piston spring cage, which forms a part of a cam follower arrangement, referred to generally as 42. The cam follower arrangement 42 further includes an advance piston spring 50, in the form of a helical spring, which is housed within the advance piston spring cage 40.

The advance piston spring cage 40 includes a cup portion having an annular flange 40*a* at its base end and an opening 40*b* at its top end. The pumping plunger 16 extends through the opening 40*b* in the advance piston spring cage 40 and projects into the main body of the cup portion. The upper end of the plunger return spring 38 abuts the spring plate member 36 carried by the lower end of the pump housing 12 and the lower end of the spring 38 abuts the annular flange 40*a* of the advance piston spring cage 40. The plunger return spring 38 serves to bias the pumping plunger outwardly from the plunger bore 14 (i.e. in a downward direction in the orientation shown), towards the cam follower arrangement 42.

The cam follower arrangement 42 is interposed between the engine driven cam and the pumping plunger 16 and includes a follower or drive member in the form of a tappet 44. A lower region of the tappet 44 defines a downwardly depending arch 46 which is shaped to cooperate with a cam roller 48. As is known in the art, the engine driven cam provides a lobed cam surface which the cam roller 48 rides over as the cam rotates. As the roller 48 rides up the cam lobe the pumping plunger 16 is driven to perform the pumping stroke and as the roller 48 rides down the cam lobe the pumping plunger 16 performs the return stroke.

At the foot of the pumping plunger 16, its lower face abuts a timing advance piston 56 (referred to as the advance piston) which is received within a blind bore 58 provided in the upper region of the tappet 44. The advance piston 56 defines an internal chamber, referred to as the control chamber 60. The control chamber 60 is further defined by a lower region 58*a* of the tappet bore, of reduced diameter, and includes an upper chamber region 60*a*. The advance piston 56 is movable within the tappet bore 58 under the influence of a control means (not shown) for controlling the supply of fluid (e.g. oil) to the control chamber 60. In response to the control means, the advance piston is operable to move between retarded and advanced positions. The advance piston spring 50 applies a biasing force to the advance piston 56 so as to bias the advance piston 56 into its retarded position in which it rests against the base 58*b* of the tappet bore 58. In response to a supply of fluid to the control chamber 60, the advance piston 56 is moved away from its retarded position, against the advance piston spring force, into an advanced position, as will be described in further detail below.

The advance piston spring 50 is nested within the advance piston spring cage 40 so that a lower end of the pumping plunger 16 is received through the advance piston spring 50. A spring plate 52 carried by the lower end of the pumping plunger 16 provides an abutment plate for the lower end of the advance piston spring 50. The upper end of the advance piston spring 50 engages an internal surface of the advance piston spring cage 40. The advance piston spring cage 40 is itself received within the plunger return spring 38, so that the advance piston spring 50 and the plunger return spring 38 are substantially coaxial with one another. The advance piston spring cage 40 is connected, via its annular flange 40*a*, to the tappet 44.

This particular arrangement of springs 38, 50 is advantageous as it ensures that the pre-load of the advance piston spring 50 is consistent between different fuel pumps, regardless of the particular timing shim 23 that is used to set the static timing of the pump. The benefit is achieved because the advance piston spring 50 is biased against the advance piston spring cage 40 mounted on the tappet 44, and not against the shim 23 of the pump housing 12 as in conventional arrangements.

A second spring cage 64 is received within the control chamber 60, the second spring cage 64 having an annular flange 64*a* at its base which locates within the lower region 58*a* of the control chamber 60. A retaining spring 62 for the second spring cage 64 is also received within the control chamber 60. The upper end of the cage retaining spring 62 is engaged with the upper internal surface of the control chamber 60, whilst the lower end of the spring 62 is engaged with the annular flange 64*a* of the second spring cage 64. The cage retaining spring 62 provides a relatively low force to the flange 64*a* of the second spring cage 64 to ensure that the cage is maintained in position throughout the pumping cycle, and particularly during that part of the cycle for which the roller 48 is decelerating over the nose of the cam (i.e. that part of the pumping cycle for which the pumping plunger 16 is decelerating).

The control means for the advance piston 56 includes a temperature-sensitive valve which is operable in response to engine temperature so as to control fluid supply through an inlet port 66*a* of a supply passage 66 provided in the tappet 44. The supply passage 66 extends laterally through the tappet 44 and terminates at a blind end. A side passage 68 from the supply passage 66 provides a communication path between the supply passage 66 and the control chamber 60 via a non-return valve 70 located at the inlet to the chamber 60. The non-return valve 70 includes a ball which is biased against a ball valve seating by means of a ball valve spring 72 which is held in place within the second spring cage 64. The non-return valve 70 is biased by means of the ball valve spring 72 to close communication between the supply passage 66 and the control chamber 60. The second spring cage 64 not only retains the ball valve spring 72 in place, but also serves to limit the extent of ball valve lift away from the ball valve seating.

Figure 4:
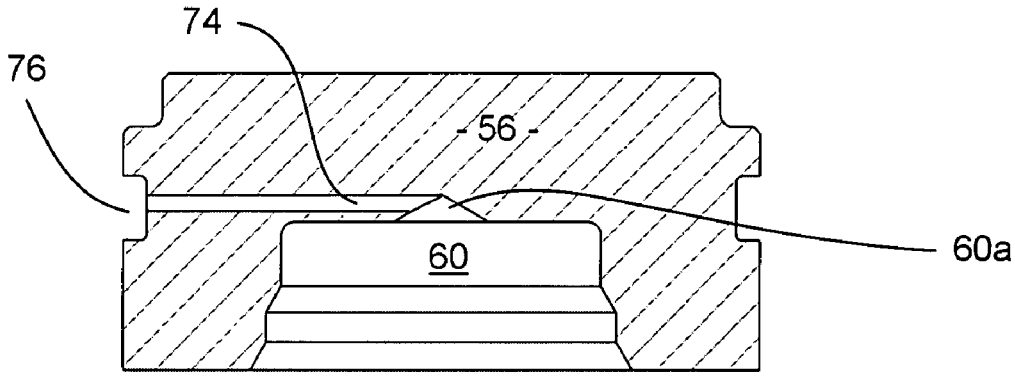
FIG. 4 is a further enlarged view of an advance piston of the timing advance arrangement in FIGS. 1 to 3.

As can be seen more clearly in FIG. 4, the advance piston 56 is provided with a lateral drilling 74 which extends from the upper end region 60*a* of the control chamber 60 to the outer circumferential surface of the advance piston 56. The outer surface of the advance piston 56 is provided with an annular groove 76, which extends around the full circumference of the piston surface and with which a radially outermost end of the lateral drilling 74 communicates. The lateral drilling 74 and the annular groove 76 together define a balancing or centralising means for the advance piston 56. The balancing effect is provided as fluid that is delivered from the control chamber 60 through the lateral drilling 74 to the annular groove 76 exerts a balanced radial load to the full circumference of the advance piston 56, as described further below.

In general, the cam follower arrangement 42 cooperates with the engine driven cam, in use, so as to drive the pumping plunger 16 within the plunger bore 14 in a reciprocating manner. The pumping plunger 16 is driven by means of the cam follower arrangement 42 to perform the pumping stroke, during which fuel within the pumping chamber 18 is pressurised, following which the pumping plunger 16 performs a return stroke, in which it is withdrawn from the plunger bore 14 under the force of the plunger return spring 38 and the pumping chamber 18 is filled.

More specifically, during the return stroke as the roller 48 passes over the return flank portion of the lobe of the cam, the pumping plunger 16 is retracted from the plunger bore 14 under the influence of the plunger return spring 38. The helical groove 17 on the pumping plunger 16 aligns with the fill/spill port 20 and fuel is drawn into the expanding volume of the pumping chamber 18 through the port 20. Additional fuel is drawn into the pumping chamber 18 after the pumping plunger 16 has withdrawn sufficiently far from the plunger bore 14 for the upper control edge on the pumping plunger 16 to have passed the fill/spill port 20. The advance piston spring 50 applies a biasing force to the foot of the pumping plunger 16 (via the spring plate 52) so as to ensure contact is maintained between the pumping plunger 16 and the advance piston 56 during this stage of operation. The plunger return spring 38 serves to maintain contact between the cam follower arrangement 42 and the cam.

As the roller 48 rides up the lobe of the cam during the pumping stroke, the tappet 44 is driven in an upwards direction (in the orientation shown), which, via the advance piston 56, causes the pumping plunger 16 to be driven inwardly within the plunger bore 14 to reduce the volume of the pumping chamber 18 (the plunger pumping stroke). For that period of the pumping stroke after which the upper control edge of the pumping plunger 16 closes the fill/spill port 20, and before the lower control edge defined by the helical groove 17 opens the fill/spill port 20, fuel within the pumping chamber 18 is pressurised. As pumping plunger 16 carries out its pumping stroke, the pressure of fuel in the chamber 18 is increased, the outlet valve 26 is caused to open and hence fuel is delivered to the downstream injector. A point will be reached at which the helical groove 17 on the pumping plunger 16 becomes aligned with the fill/spill port 20 so that fuel within the pumping chamber 18 is displaced to the low pressure drain. This point of alignment between the groove 17 and the port 20 dictates termination of fuel pressurisation and, hence, injection.

It will be appreciated that the axial position of the advance piston 56 (together with the angular position of the pumping plunger 16) dictates the point in the pumping stroke during which pressurisation is commenced, as the axial position of the advance piston 56 within the tappet bore 58 dictates, in conjunction with the plunger timing control features, the timing of injection. The angular position of the pumping plunger 16 determines the point in the pumping stroke at which the helical groove 17 is aligned with the fill/spill port 20 to terminate injection. Operation of the timing advance arrangement to adjust the timing of commencement of fuel injection will now be described.

If the temperature of the engine is less than a predetermined amount, the temperature-sensitive valve is opened so as to allow fluid to flow through the supply passages 66, 68 in the tappet 44 into the control chamber 60. The temperature-sensitive valve is open when the engine is started and stays open until the engine reaches its normal operating temperature, at which time it shuts.

With the temperature-sensitive valve open, fluid is able to flow through the passages 66, 68 in the tappet 44. This occurs for the lower (initial) part of the stroke, after which the supply of fluid is cut off due to the inlet port 66*a* of the supply passage 66 becoming misaligned with the fluid supply. As a result of the fluid being supplied through the passages 66, 68, the non-return valve 70 is caused to lift from its seat, against the force of the ball valve spring 72, and fluid flows into the control chamber 60. As the cam follower 42 and the pumping plunger 16 start to move upwards on the pumping stroke, the non-return valve 70 is caused to close and fluid is retained in the control chamber 60.

Typically, after several rotations of the engine, the pressure build up in the control chamber 60 applies a hydraulic lifting force to the advance piston 56. The advance piston spring 50 opposes movement of the advance piston 56 until the force due to the fluid pressure in the control chamber 60 matches the pre-load of the spring 50, after which the advance piston 56 is caused to move upwards within the tappet bore 58, against the spring force. As a result, the axial position of the pumping plunger 16 within the plunger bore 14 is advanced and the timing of commencement of pressurisation is advanced for subsequent pumping cycles. Upward movement of the advance piston 56 is limited by contact with the lower surface of the annular flange 40*a* of the advance piston spring cage 40.

The force due to fuel pressure in the pumping chamber 18, which opposes the driving load, leads to fluid in the control chamber 60 flowing into the lateral drilling 74 and, hence, into the groove 76 in the outer surface of the piston 56. The effect is greatest under high load conditions when fuel within the pumping chamber 18 is fully pressurised. In ideal conditions, the pressure is balanced between the groove 76 and the control chamber 60. The presence of fluid in the groove 76 applies a radial force to the advance piston 56 around its full circumference which tends to compensate for any off-axis tilt that may otherwise occur and/or for any concentricity misalignment between the tappet bore 58 and the advance piston 56. It is therefore one benefit of the feature of the groove 76 that tilt of the advance piston 56 within the tappet bore 58 is reduced, hence reducing the risk of the advance piston 56 digging into the tappet bore 58 and also reducing the risk wear.

As the temperature of the engine increases, the temperature-sensitive valve is operated so as to close the supply of fluid to the control chamber 60 through the passage 66, 68 in the tappet 44. As a result, fluid within the control chamber 60 will leak to drain through the lateral drilling 74 and the groove 76, via the clearance between the tappet bore 58 and the outer surface of the advance piston 56. As fluid leaks from the control chamber 60, the hydraulic lifting force acting on the advance piston 56 is reduced so that the advance piston 56 is urged back towards its retarded position in which its lower surface abuts the base 58*a* of the tappet bore 58 (i.e. the position shown in FIG. 3). In this position the pumping plunger 16 adopts a lower starting position in the plunger bore 14 so that the timing of commencement of pressurisation on the pumping stroke is retarded, compared with the situation described previously.

It will be appreciated that the particular arrangement of the lateral drilling and the groove need not be as shown in the accompanying figures in order to achieve the aforementioned benefits. For example, it is possible to provide a plurality of drillings between the control chamber and the groove. Also, the or each drilling need not communicate with the uppermost end 60*a* of the control chamber 60, as described previously, but may be positioned part way along the axial length of the control chamber. At the expense of some benefit in providing an anti-tipping force, the annular groove may also be replaced by two or more part-annular grooves, positioned directly opposite one another on the circumferential surface of the advance piston.

In a further modification, the drilling 74 to the groove 76 may be angled and or more than one groove may be provided along the axial length of the advance piston 56. Other options for the non-return valve 70, other than a ball valve, are also possible, for example a plate valve or a cone-to-cone valve.

The invention claimed is:

1. A fuel pump for use in an internal combustion engine, the fuel pump comprising:

a pump housing provided with a plunger bore and a pump outlet that is configured for connection to a fuel injector via a fuel supply line, a pumping plunger that is movable within the plunger bore by means of a cam drive arrangement to perform a pumping stroke to pressurise fuel within a pumping chamber, an outlet valve arranged and configured to control the flow of fuel from the pumping chamber to the pump outlet, a cam follower arrangement interposed between the cam drive arrangement and the pumping plunger so as to transmit a drive force of the cam drive arrangement to the pumping plunger, wherein the cam follower arrangement includes a timing advance piston for advancing or retarding the timing of the pumping stroke, and a controller for controlling the timing advance piston so as to advance or retard the timing of the pumping stroke, wherein the timing advance piston is provided with a groove on its outer surface for receiving fluid, thereby to provide a centralising force to the timing advance piston in use.

2. The fuel pump as claimed in claim 1, wherein the cam follower arrangement includes a follower body provided with a bore within which the timing advance piston is movable.

3. The fuel pump as claimed in claim 1, wherein the groove is an annular groove that extends fully around the circumference of the outer surface of the timing advance piston.

4. The fuel pump as claimed in claim 1, wherein the timing advance piston defines a control chamber for receiving fluid under the control of the controller.

5. The fuel pump as claimed in claim 4, wherein the controller includes a valve for controlling fluid supply to the control chamber.

6. The fuel pump as claimed in claim 5, wherein the valve is a temperature-sensitive valve that is operable to permit fluid supply to the control chamber under relatively cold conditions.

7. The fuel pump as claimed in claim 4, wherein the controller includes a non-return valve arranged at an inlet to the control chamber.

8. The fuel pump as claimed in claim 7, wherein the non-return valve is retained within a further spring cage located within the control chamber.

9. The fuel pump as claimed in claim 8, including a retaining spring that acts on the further spring cage to retain the further spring cage in position during the return stroke of the pumping plunger and a period of the pumping stroke of the pumping plunger for which the pumping plunger is decelerating.

10. The fuel pump as claimed in claim 4, wherein the control chamber communicates with the groove by means of a lateral drilling or bore provided in the timing advance piston.

11. The fuel pump as claimed in claim 1, including a plunger return spring that serves to bias the pumping plunger outwardly from the plunger bore to perform a return stroke.

12. The fuel pump as claimed in claim 11, wherein the cam follower arrangement includes an advance piston spring that urges the timing advance piston into a retarded position.

13. The fuel pump as claimed in claim 12, wherein the cam follower arrangement includes a spring cage that houses the advance piston spring.

14. The fuel pump as claimed in claim 13, wherein an end of the pumping plunger is received within the spring cage.

15. The fuel pump as claimed in claim 13, wherein one end of the advance piston spring is in engagement with an internal surface of the spring cage.

16. The fuel pump as claimed in claim 13, wherein one end of the advance piston spring is in engagement with a spring plate carried by the pumping plunger.

17. The fuel pump as claimed in claim 13, wherein the spring cage is carried by a drive member of the cam follower arrangement.

18. The fuel pump as claimed in claim 12, wherein the advance piston spring and the plunger return spring are substantially concentric with one another.

19. A fuel pump for use in an internal combustion engine, the fuel pump comprising:

a pump housing provided with a plunger bore and a pump outlet that is configured for connection to a fuel injector via a fuel supply line, a pumping plunger that is movable within the plunger bore by means of a cam drive arrangement to perform a pumping stroke to pressurise fuel within a pumping chamber, an outlet valve arranged and configured to control the flow of fuel from the pumping chamber to the pump outlet, a plunger return spring for biasing the pumping plunger outwardly from the plunger bore, and a cam follower arrangement interposed between the cam drive arrangement and the pumping plunger so as to transmit a drive force of the cam drive arrangement to the pumping plunger, wherein the cam follower arrangement includes a timing advance piston for advancing or retarding the timing of the pumping stroke that is biased into a retarded position by means of an advance piston spring, the cam follower arrangement including a spring cage having a cup portion, wherein an end of the plunger return spring surrounds the cup portion and the advance piston spring is housed within the cup portion.

20. The fuel pump as claimed in claim 19, wherein an end of the pumping plunger is received within the spring cage.

21. The fuel pump as claimed in claim 19, wherein one end of the advance piston spring is in engagement with an internal surface of the spring cage.

22. The fuel pump as claimed in claim 19, wherein one end of the advance piston spring is in engagement with a spring plate carried by the pumping plunger.

23. The fuel pump as claimed in claim 19, wherein the spring cage is carried by a drive member of the cam follower arrangement.

24. A fuel pump for use in an internal combustion engine, the fuel pump comprising:

a pump housing provided with a plunger bore and a pump outlet that is configured for connection to a fuel injector via a fuel supply line, a pumping plunger that is movable within the plunger bore by means of a cam drive arrangement to perform a pumping stoke to pressurise fuel within a pumping chamber, an outlet valve arranged and configured to control the flow of fuel from the pumping chamber to the pump outlet, a cam follower arrangement interposed between the cam drive arrangement and the pumping plunger so as to transmit a drive force of the cam drive arrangement to the pumping plunger, wherein the cam follower arrangement includes a timing advance piston for advancing or retarding the timing of the pumping stroke, and a temperature-sensitive valve for controlling fluid supply to a control chamber defined by the timing advance piston, so as to advance or retard the timing of the pumping stroke, wherein the timing advance piston has a groove that extends around its outer surface that communicates with the control chamber so that fluid within the groove provides a centralising force to the timing advance piston, in use.

* * * * *